US007861462B2

(12) United States Patent
Smith et al.

(10) Patent No.: US 7,861,462 B2
(45) Date of Patent: Jan. 4, 2011

(54) VEHICLE WINDOW REGULATOR HAVING A FLOATING WINDOW CARRIER

(75) Inventors: Peter J. Smith, Newmarket (CA); Dan R. Gidden, Bradford (CA); Noel Chingcuanco, North York (CA)

(73) Assignee: Magna Closures Inc., Newmarket, Ontario (CA)

( * ) Notice: Subject to any disclaimer, the term of this patent is extended or adjusted under 35 U.S.C. 154(b) by 415 days.

(21) Appl. No.: 10/580,928

(22) PCT Filed: Dec. 3, 2004

(86) PCT No.: PCT/CA2004/002075

§ 371 (c)(1),
(2), (4) Date: Feb. 21, 2007

(87) PCT Pub. No.: WO2005/054615

PCT Pub. Date: Jun. 16, 2005

(65) Prior Publication Data

US 2007/0277441 A1 Dec. 6, 2007

(51) Int. Cl.
*E05F 11/40* (2006.01)

(52) U.S. Cl. ..... 49/360; 49/348; 49/362

(58) Field of Classification Search ..... 49/348, 49/349, 360, 362, 374, 375, 213
See application file for complete search history.

(56) References Cited

U.S. PATENT DOCUMENTS

| | | | | |
|---|---|---|---|---|
| 2,945,691 | A * | 7/1960 | Swift et al. | 74/89.36 |
| 2,947,535 | A | 8/1960 | Crosby | |
| 3,228,677 | A * | 1/1966 | Martens | 49/41 |
| 4,106,353 | A * | 8/1978 | Kondo | 74/45 |
| 4,241,542 | A * | 12/1980 | Podolan et al. | 49/352 |
| 4,575,967 | A | 3/1986 | Bickerstaff | |
| 4,771,575 | A * | 9/1988 | Tiesler | 49/211 |
| 5,012,613 | A | 5/1991 | Sekine | |
| 5,309,677 | A | 5/1994 | Kunert et al. | |
| 5,651,217 | A * | 7/1997 | Mesnel | 49/441 |
| 6,427,385 | B1 * | 8/2002 | Fin | 49/340 |
| 2004/0003544 | A1 * | 1/2004 | Berry et al. | 49/374 |
| 2004/0045221 | A1 * | 3/2004 | Oberheide et al. | 49/349 |
| 2004/0144032 | A1 * | 7/2004 | Smith | 49/352 |
| 2004/0187391 | A1 * | 9/2004 | Fenelon | 49/375 |

FOREIGN PATENT DOCUMENTS

| | | |
|---|---|---|
| CA | 2430023 | 11/2003 |
| EP | 1455043 | 9/2004 |
| FR | 1294605 | 5/1962 |

OTHER PUBLICATIONS

International Search Report for PCT/CA2004/002075 Dated Mar. 21, 2005.
International Preliminary Examination Report for PCT/CA2004/002075 Dated Mar. 10, 2006.

* cited by examiner

*Primary Examiner*—Katherine W Mitchell
*Assistant Examiner*—Daniel Cahn
(74) *Attorney, Agent, or Firm*—Clark Hill PLC

(57) ABSTRACT

A window regulator including a drive rod having a linear axis; a runner connected to the drive rod for movement therealong; a window carrier pivotally secured to the runner for supporting a window; and a guide engaged by the window carrier having a radius of curvature such that the window carrier moves the window along a path coincident with the radius of curvature as the runner moves linearly along the drive rod.

8 Claims, 10 Drawing Sheets

VEHICLE WINDOW REGULATOR HAVING A FLOATING WINDOW CARRIER

FIELD OF THE INVENTION

This invention relates to a window regulator, as used in a vehicle door.

BACKGROUND OF THE INVENTION

A window regulator is a mechanism under which control a vehicle window, e.g. a passenger door window is raised and lowered. Various types of window regulators are known.

In modern vehicles, auto windows are generally curved, having a major outwardly convex surface. A side door window, for example, thus has a forward upright edge and a rearward upright edge, each located in an arcuate guide rail which defines a travel path followed by the window as it moves between upper and lower positions. It is in this context that advantages of the invention described herein would be most apparent.

SUMMARY OF THE INVENTION

According to one aspect of the invention a window regulator is provided which includes a linear element, such as a frame or rod, that defines a first axis. A runner is mounted to translate linearly along the linear element. A window carrier is pivotally and slidably connected to the runner so as to translate along a second axis substantially orthogonal to the first axis and rotate about a third axis substantially orthogonal to both the first and second axes. This device enables an arcuate window to be mounted to the window carrier. The window is slidably mounted in at least one glass run channel having a curvature substantially identical to the curvature of the window. When the runner is translated along the linear element using any suitable means, the runner follows a linear path but the window and window carrier will follow an arcuate path dictated by the glass run channels.

According to another aspect of the invention, a window regulator is provided having a runner that travels along a guide rod. A carrier is connected to the window, and the runner engages the carrier to force the window up and down as the runner travels along the guide rod. The engagement of the runner and carrier provides for movement of the carrier along the travel path of the window without necessarily precisely following the travel path of the runner.

The upright edges of such a window are engaged by guide rails within the vehicle door, the guide rails being generally arcuate to match the arcuate shape of the window, and to define the travel path of the window as it moves up or down. The carrier, e.g. support plate, affixed at the bottom of the window must follow the arcuate travel path of the window. The runner, which is forced by a generally conventional means to move up and down along the guide rod engages the carrier. Because the invention permits the window carrier to move with respect to the rod in a direction that is not precisely parallel to the travel path of the runner, the rod is not required to be in the shape of the travel path of the window, that is, the rod is not required to have the arcuate shape of the rail guides.

Automotive doors come in a variety of shapes and sizes, and so too do their windows. Windows thus have differing degrees of curvature, which of course determines the different travel path each must follow when being raised and lowered. Because the travel path of the runner, i.e., the shape of the guide rod is not required to match the curvature of the window guide rails, a lift mechanism of the present invention (outside of the guide rails) can be used with windows of differing degrees of curvature.

In one of the embodiments described below, one or the other of the runner and the carrier preferably includes a pair of channels generally traverse to a major window surface (i.e., generally orthogonal to the travel of the runner) and the other of the runner and the carrier includes a pair of trunnions. Each trunnion is received in one each of the channels and each trunnion includes a surface which is shaped to engage a surface of the channel into which it is received to permit, as the runner travels in an axial direction along the rod, movement of the carrier along the arcuate travel path of the window.

Other means for slidingly and pivotally connecting the carrier to the runner are described in greater detail below.

BRIEF DESCRIPTION OF THE DRAWINGS

A detailed description of the invention, including the best mode of the invention currently known or contemplated by the inventor is set out below, reference being made to the attached drawings in which.

DETAILED DESCRIPTION OF PREFERRED EMBODIMENTS

Figure 1:
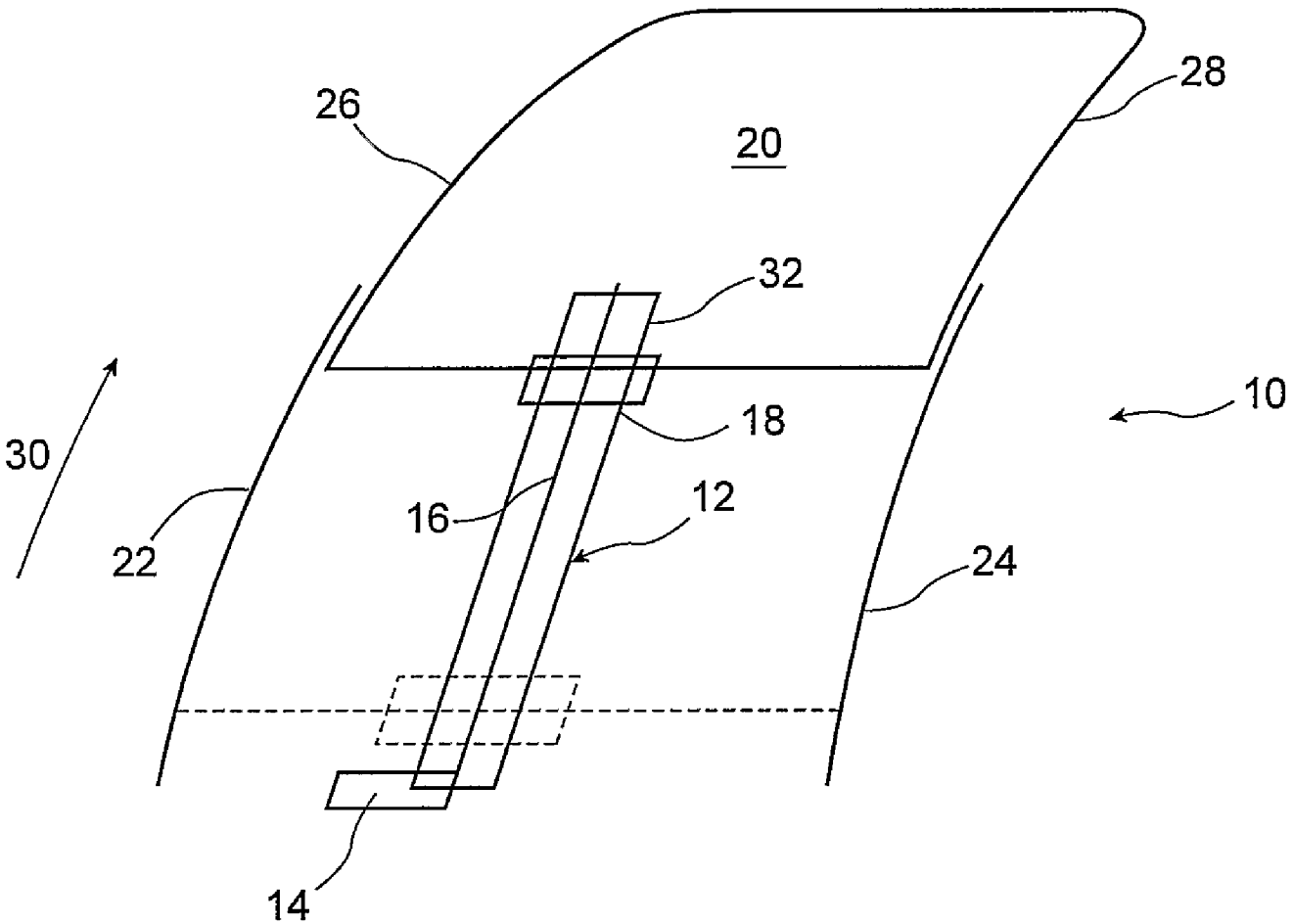
FIG. 1 illustrates generally a vehicle side door having a window regulator assembly according to the invention installed therein.

Turning to the drawings, a window regulator assembly 12 is schematically illustrated in FIG. 1. The assembly 12 is installed as part of vehicle side passenger door 10 and includes a linear lead screw or threaded drive rod 16 extending in a vertical direction and rotatably mounted on a frame 32. A carrier plate 18 is slidingly mounted to the frame 32 and also slidingly and pivotally mounted to the drive rod 16, as described in greater detail below. An arcuate window 20 is mounted to the carrier plate 18 at the lower edge of the window 20. The assembly 12 includes arcuate forward and rearward glass run channels 22, 24 which receive, respectively, the forward upright edge 26 and rearward upright edge 28 of the window 20. As described in greater detail below, rotation of the drive rod 16 leads to axial and pivotal movement of the carrier plate 18 therealong corresponding to the arcuate travel path of the window 20 as it rides upwards and downwards in the arcuate glass run channels 22, 24.

Figure 2:
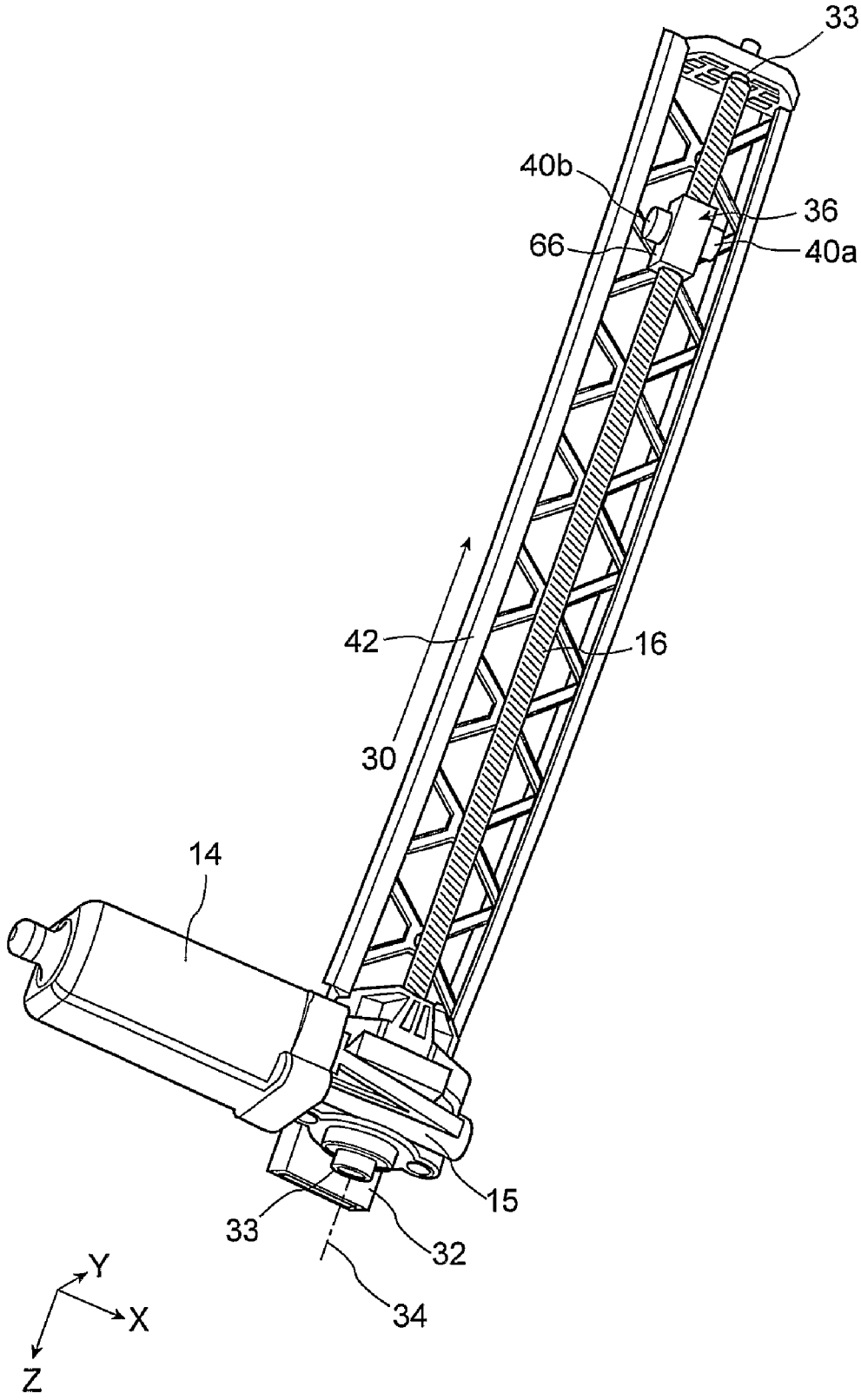
FIG. 2 is an isometric view showing the components of a drive mechanism according to a first embodiment of the invention.

FIG. 2 is an isolated view of the drive components of window regulator assembly 12 according to a first embodiment. The assembly 12 includes a longitudinal base frame 32 secured within the interior of the door 10 at both ends thereof. The drive rod 16 is journaled for stationary rotation in the frame 32 via bushings 33. The actuator, such as electric motor 14 coupled to a gear reducer 15, is drivingly connected to the lower end of drive rod 16 by any suitable manner known in the art, such as through the use of gears, a belt drive, a flexible cable or a universal joint, in order to rotate the drive rod about its central linear axis 34. A runner 36 having an internal threaded bore 38 is threadingly mounted on the drive rod 16. As will be explained further below, in the fully assembled mechanism, runner 36 is prevented from rotating with respect to the drive rod, and thus the runner travels axially along the drive rod 16 when it rotates, either up or down, depending upon the direction of the rotation. The travel path of the runner 36 thus parallels the central linear rotational axis 34 of drive rod 16, and thus the drive rod 16 essentially acts as a guide rod for the runner 36. Runner 36 includes trunnions 40*a*, 40*b* which have an elliptical cross section, the purpose of which will be described in greater detail below. Base frame 32 includes an integrally formed guide 42 having the same arcuate bend as window channel runs 22, 24, the function of guide 42 being described further below.

Figure 3:
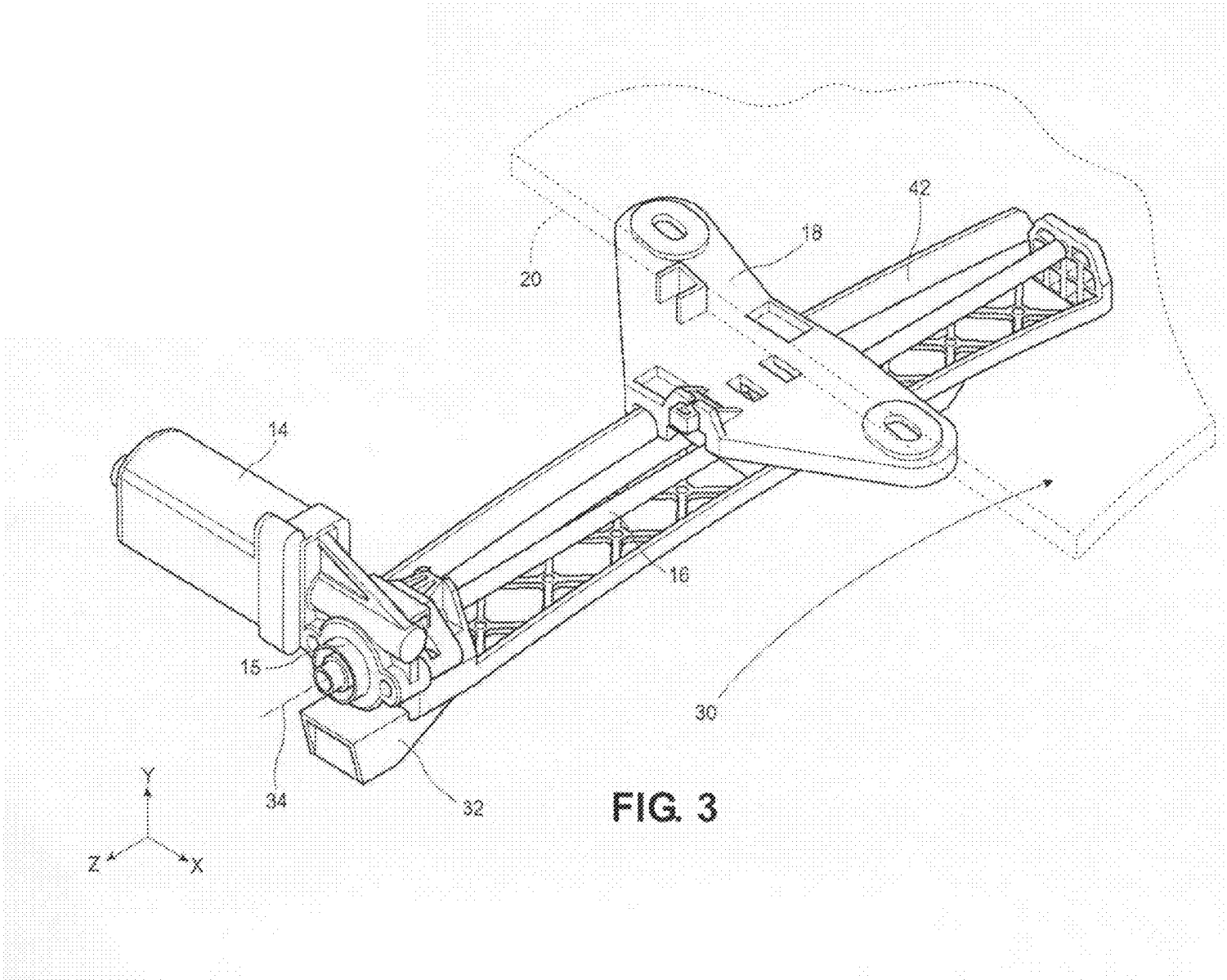
FIG. 3 is a view similar to that of FIG. 2, showing a carrier plate for the window installed.
Figure 4:
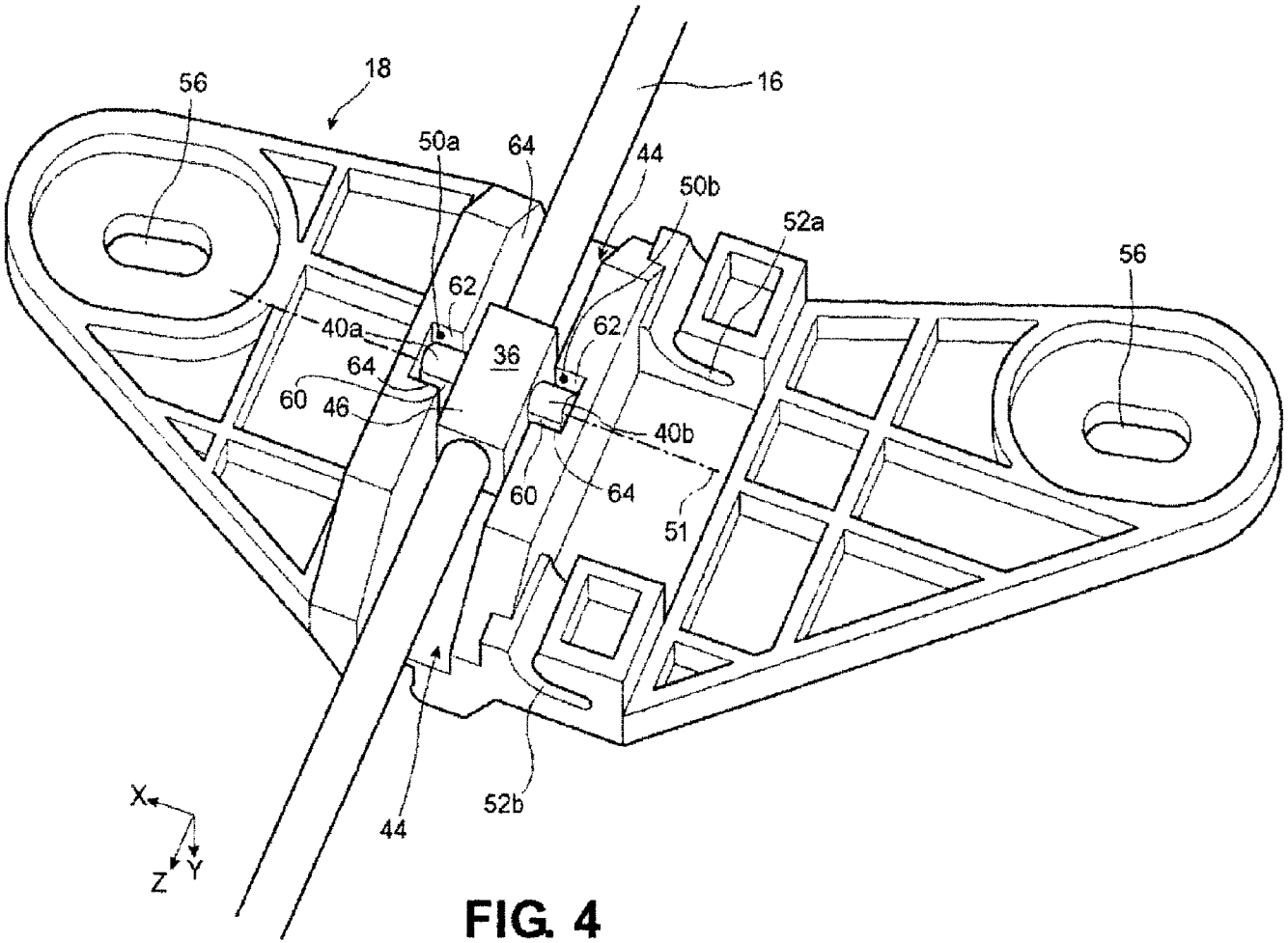
FIG. 4 is an isometric view showing the inner and lowers sides of the carrier plate shown in FIG. 3 in relation to certain drive components.

FIG. 3 is similar to FIG. 2, but shows carrier plate 18 installed on frame 32. Referring additionally to the isolated view of FIG. 4, carrier plate 18 includes a primary channel 44, which is generally axially upright when installed. In other words, the primary channel 44 extends in the vertical direction. The channel 44 receives a longitudinal body portion 46 of runner 36. The trunnions 40*a*, 40*b*, which protrude from the longitudinal body portion 46 of runner 36, seat in secondary channels 50*a*, 50*b*, respectively, cut into sidewalls 64 of carrier plate 18. The secondary channels 50*a*, 50*b* extend in a lateral direction substantially orthogonal to the vertical direction and the trunnions 40*a*, 40*b* define a lateral axis 51 substantially orthogonal to the central axis 34. Carrier plate 18 also defines slider channels 52*a*, 52*b*, which receive guide 42 of frame 32.

Figure 5:
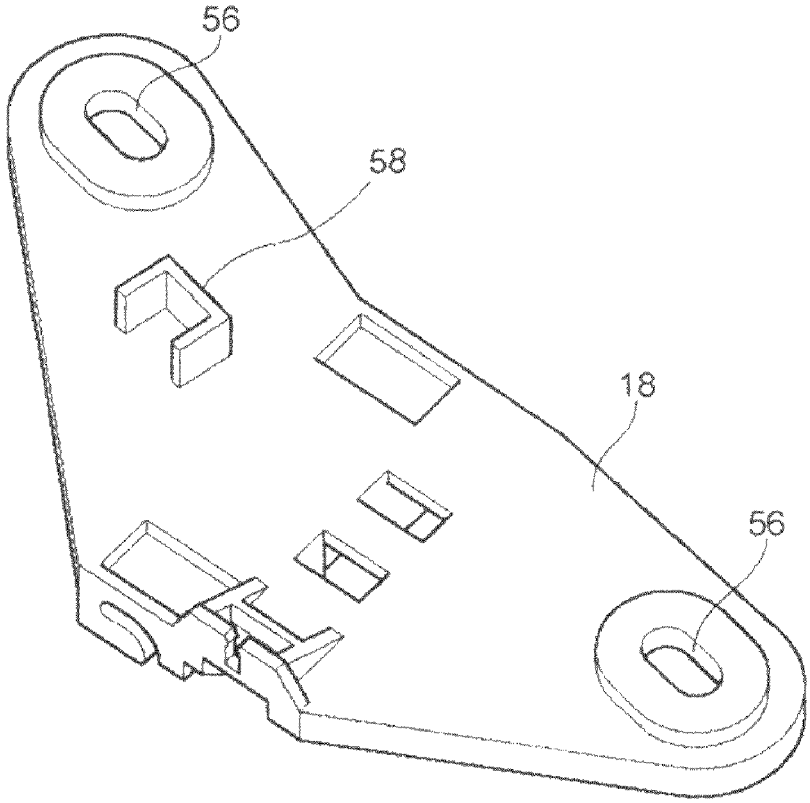
FIG. 5 is an isometric view showing the outer and lower sides of the carrier plate shown in FIG. 3.

Plate 18 is rigidly affixed to window 20 by means of fasteners (not shown) received through plate apertures 56 that communicate with suitably located apertures in the window 20. Further support is leant to the plate-window connection by protruding plate support 58 (FIG. 5) on which the lower edge of the window rests 20. Many other techniques for attaching glass to the carrier plate 18 are well known in the art and may be used in the alternative.

Figure 6A:
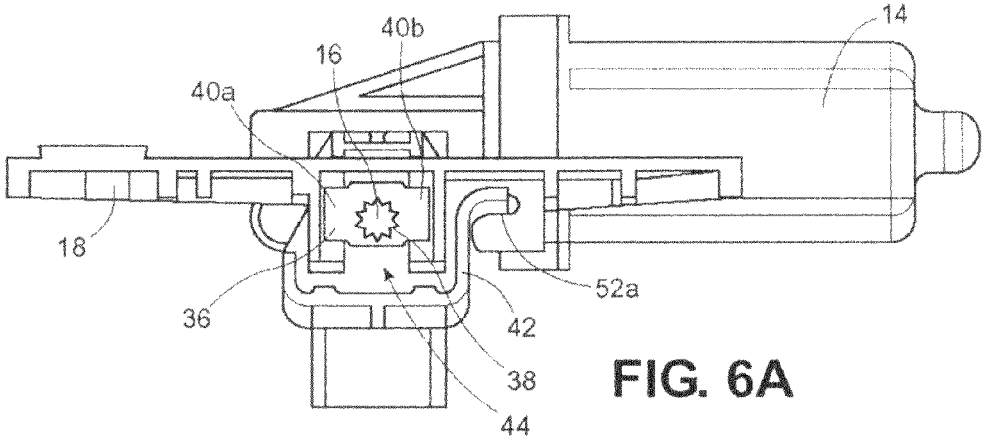
FIGS. 6A-6C are cross-sectional views of the first embodiment showing the position of a runner in a channel of the window carrier plate as the window is moved from a lower, open position (FIG. 6A) to an upper, closed position (FIG. 6C)
Figure 6C:
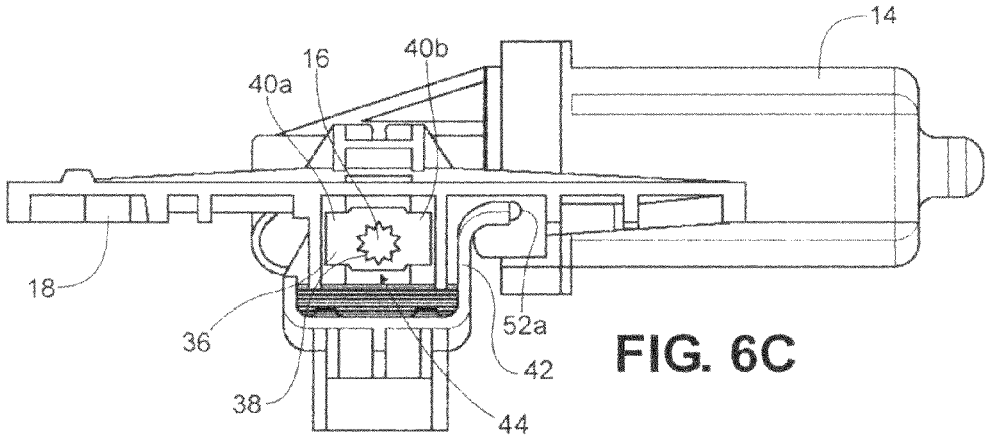
Figure 6B:
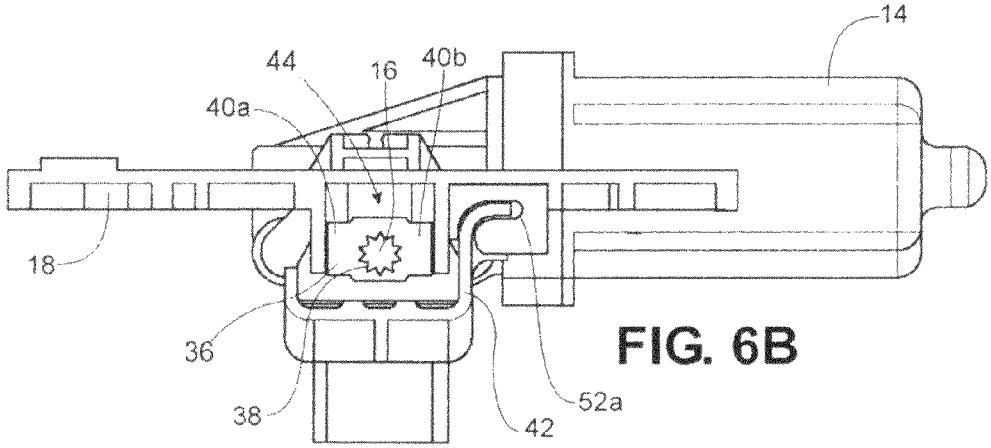

The upward and downward motion of runner 36 is caused by rotation of drive rod 16 under control of the actuator. The runner 36 is prevented from rotating with respect to drive rod 16 because longitudinal body portion 46 of runner 36 is ensconced in the primary channel 44 of carrier plate 18, abutting the side walls 64 thereof. More particularly, the cross-sectional shapes of the surfaces defining the primary channel 44 and the longitudinal portion 46 of the runner 36 match each other sufficiently to affix the runner 36 against rotation about the axis 34 of the drive rod 16 while at the same time permitting the required degree of movement of the runner 36 in other directions within the channel 44, described further below. Central axis 34 of drive rod 16 is linear so the travel path of runner 36 as it travels between the upper and lower positions shown in FIG. 1 is also linear. Window 20 and plate 18 follow parallel arcuate travel paths as defined by rails 22, 24 and guide 42, an arcuate axis of each of these being parallel to the arc indicated by arrow 30. The arcuate path followed by the plate 18, the upward and downward motion of which is driven by the runner 36, which itself follows a linear path, is accommodated by elliptical surfaces 60 of the trunnions 40*a*, 40*b* which bear on surfaces 62, 64 of the secondary channels 50*a*, 50*b* of the plate 18. In other words, the elliptical cross-section of the trunnion surfaces 60 which bear on surfaces 62, 64 of the secondary channels 50*a*, 50*b* of the carrier plate 18 permit the plate 18 to pivot slightly about the lateral axis 51 and to move towards or away from drive rod 16 (in a horizontal or cross-car direction substantially orthogonal to the vertical and lateral directions) as necessary to accommodate the non-parallel travel paths of the plate 18 and runner 36. This is shown in the cross-sectional views of FIGS. 6A-6C which illustrate the position of the runner 36 within the channel 44 as the window 20 moves from a lower, open position (FIG. 6A) to an upper, closed position (FIG. 6C). It will further be appreciated that guidance of the plate 18 along the travel path of the window 20 (as determined by guide rails 22, 24) is further assured by the fit of guide 42 on base 32 within slider channels 52*a*, 52*b*, which precludes undue stress from being placed on the window 20. In preferred embodiments, the window 20 and glass run channels 22, 24 will also have a uniform radius of curvature which is imparted to the slider channels 52*a*, 52*b*.

Figure 7:
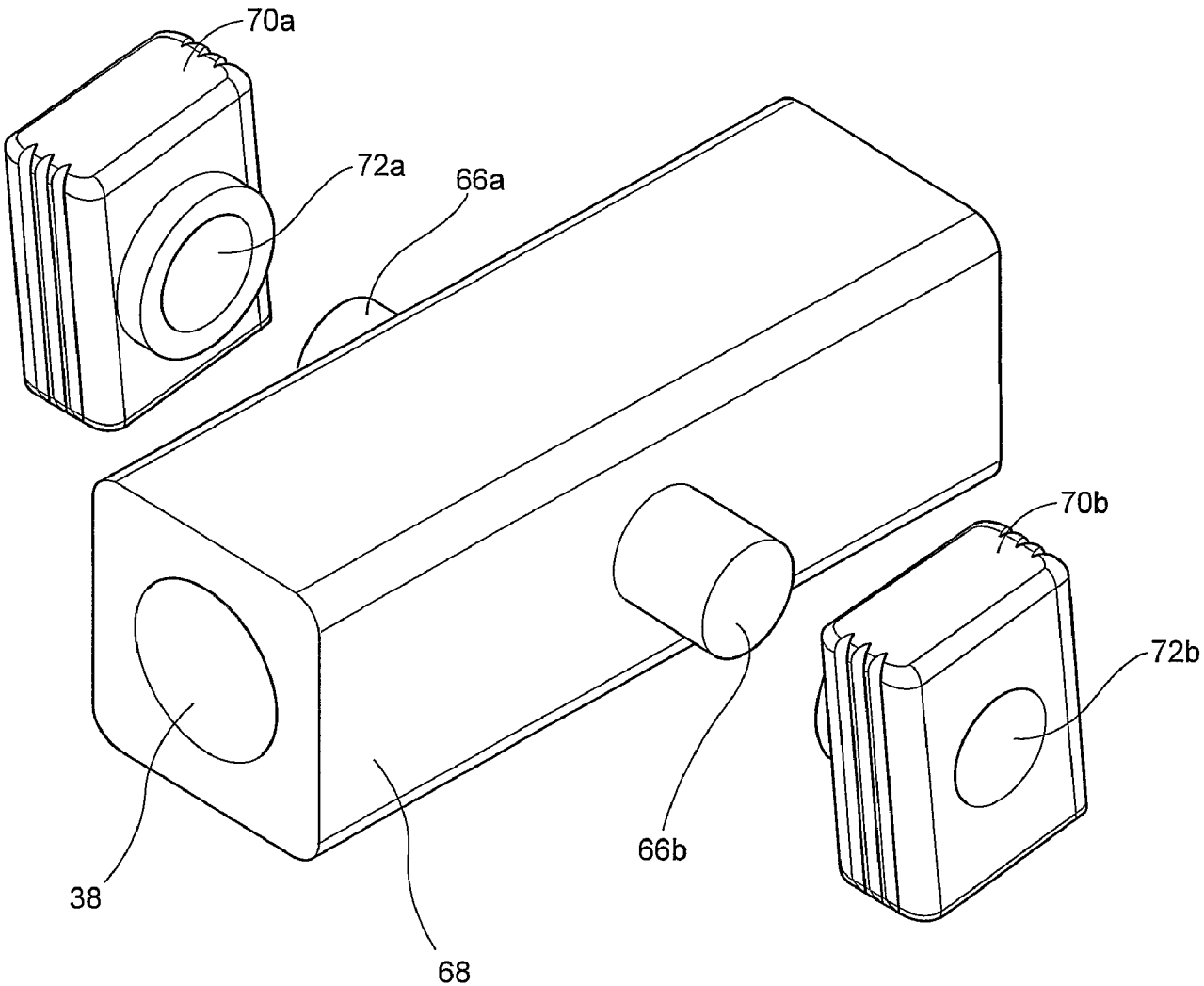
FIG. 7 is an exploded view of an alternative runner and glider combination.
Figure 8A:
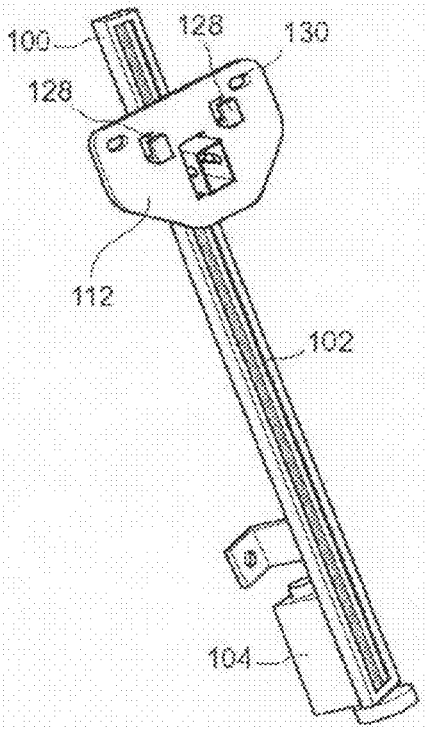
FIGS. 8A and 8B are isometric views showing the components of a drive mechanism according to a second embodiment of the invention.
Figure 8B:
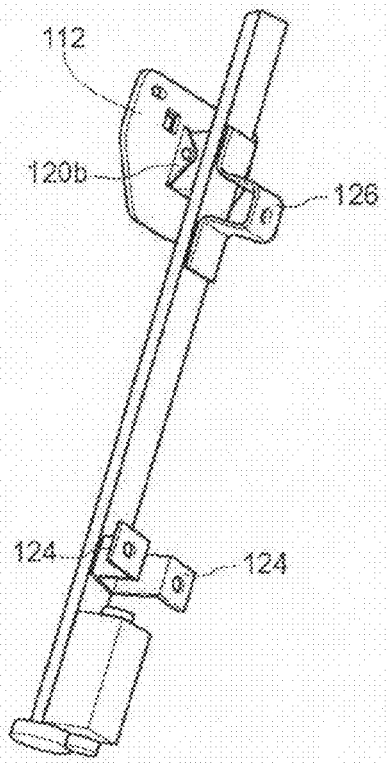
Figure 9A:
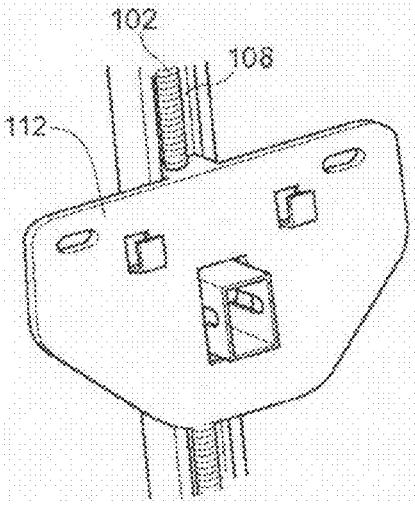
FIGS. 9A and 9B are detailed views of regions of the drive mechanism shown in FIGS. 8A and 8B, respectively.
Figure 9B:
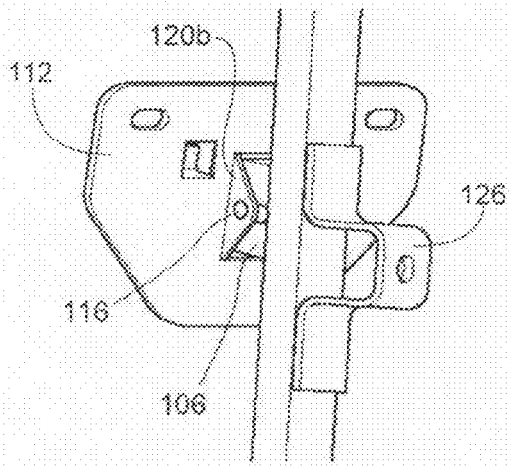
Figure 10:
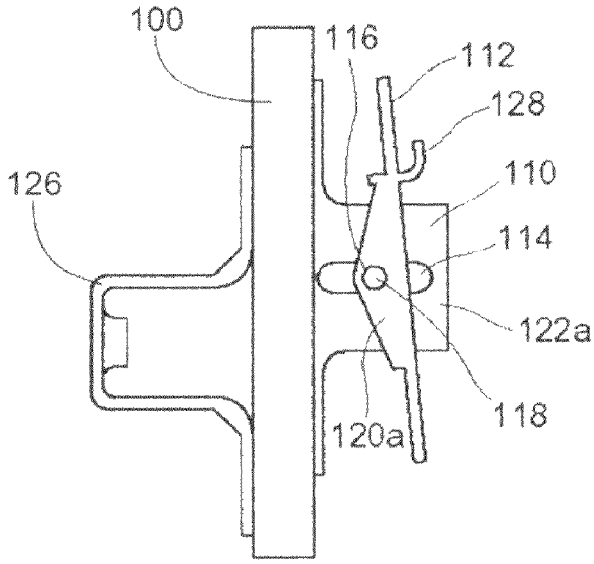
FIG. 10 is a detailed elevation view of the second embodiment.

A variant of the first embodiment is shown in FIG. 7 in which trunnions 66*a*, 66*b* of runner 68 are received within gliders 70*a*, 70*b* having apertures 72*a*, 72*b*. The gliders 70*a*, 70*b*, in turn, are mounted in the secondary channels 50*a*, 50*b* of the carrier plate 18.

It will be noted from the foregoing the arcuate guide 42 enables the length of the glass run channels 22, 24 to be minimized. That is, the glass run channels 22, 24 do not have to be the full height of the window travel since the guide 42/frame 32 can support the window 20 and its arcuate travel.

FIGS. 8A, 8B, 9A, 9B & 10 illustrate a second embodiment of the invention. Here, channel frame 100 has an upright threaded drive rod 102 rotatably mounted thereto. The top end is thus suitably journaled to the frame 100, with the lower end drivingly connected to motor 104. A runner 106 is seated within channel 108 of frame 100, the channel 108 being of relative constant cross section along the travel path of the runner 106, with the outer cross section of the runner 106 generally matching the cross section of the channel 108. The runner 106 is again rotatably mounted on the drive rod 102, the matching surfaces of the runner 106 and the channel 108 into which it is received precluding rotation of the runner 106 within the channel 108 so that rotation of the drive rod 102 results in the travel of the runner 106.

The runner 106 has an arm 110 protruding from the channel frame 100 and a carrier plate 112 is mounted to the arm 110. More particularly, arm 110 includes a slot 114, which lies in a plane generally orthogonal to the axis of screw 102. A carrier mounting shaft, bolt 116, is received within slot 114. Bolt 116 provides an axis of rotation 118 for the carrier plate 112, which axis 118 is parallel to the plane of the slot 114 and orthogonal to the rotational axis of drive rod 102. Mounting bolt 116 is also free to move parallel to the plane of slot 114, towards and away from screw 102, which corresponds to the cross-car direction in the case of the mechanism being installed in a passenger door of an automobile. Carrier plate 112 includes abutment walls 120*a*, 120*b*, which walls abut side walls 122*a*, 122*b* of runner arm 110 to substantially limit translational movement of the plate 112 to movement towards and away from the lead screw 102, i.e., to preclude movement of the axis of rotation 118 of the carrier plate 112 to being within the plane of the slot 114.

Channel frame 100 includes mounting members 124, 126 for affixing the window drive mechanism to the automobile, as within the interior of a car door. Again, the rotation of the carrier plate 112 about axis 118, and translation of the plate 112 in a direction parallel to the plane of slot 114, provides for the arcuate movement required of the plate 112 as it moves up and down along the rotating drive rod 102, despite the fact that the frame 100 and the drive rod 102 are linear in configuration.

Figure 11:
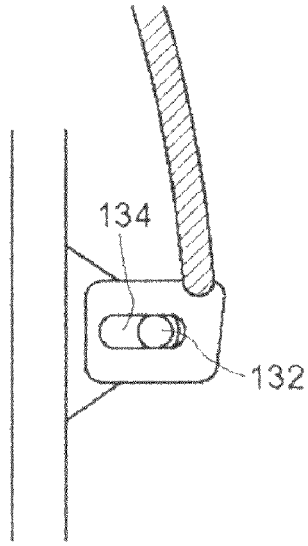
FIG. 11 is a view similar to that of FIG. 10, showing a variant window carrier plate and variant connection between the carrier plate and runner.

In a variant of the second embodiment, shown in FIG. 11, runner trunnions 132 are received within carrier plate slots 134, only one of each being illustrated in FIG. 11.

Figure 12A:
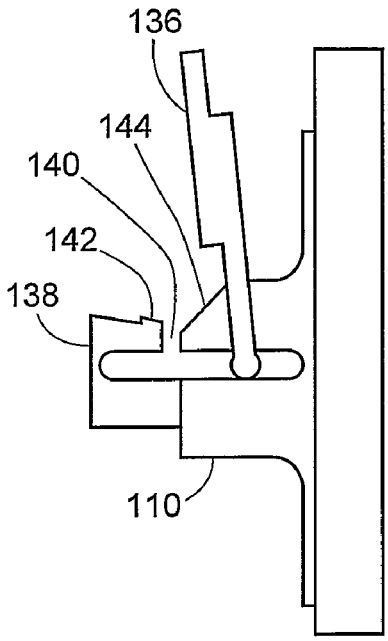
FIGS. 12A and 12B are detailed elevation views showing another variant of second embodiment, having a runner modified for convenience of installation of a window and carrier plate.
Figure 12B:
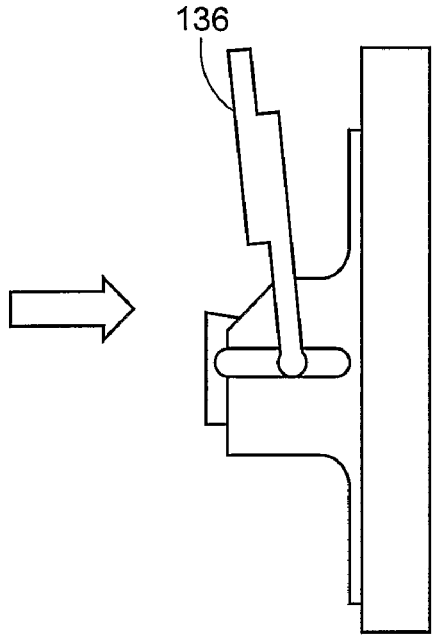

For ease of installation, runner arm 110 may include an opening into which is slidingly received separate slotted member 138. When in the open position as illustrated in FIG. 12A, in which member 138 is drawn away from the base portion of the runner arm, gap 140 is provided between the overhanging portions 142, 144 of the slotted member 138 and the base of the arm 110, respectively. When the slotted member 138 is in this position, bolt 116 of the carrier plate 112 can be received into the slot, the slotted member 138 slid into the closed position of FIG. 12B for installation of the carrier plate 112 and window 20. Suitable securing means is provided to hold the slotted member 138 in the installed position to the runner arm 110.

In the case of the second embodiment, as illustrated, the travel path of the carrier plate 112 is not fixed with respect to the channel frame 100 (as for example, by guide 42 and slider channels 52*a*, 52*b* of the first embodiment). The travel path is thus defined only by glass run channels 22, 24 suitably mounted to the automobile. See FIG. 1. One of the advantages of this embodiment is that the window travel is not dictated by the curvature of the window regulator rail which, as a result of manufacturing tolerances, may differ from the curvature of the glass run channels 22, 24. This enables the system to be used in a wide variety of vehicle doors since the rail does not have to be specifically manufactured for various vehicle models. In order to further augment this capability, the carrier plate 112 can be configured to receive a bracket to which the window pane 20 is bonded with a suitable adhesive.

Figure 13A:
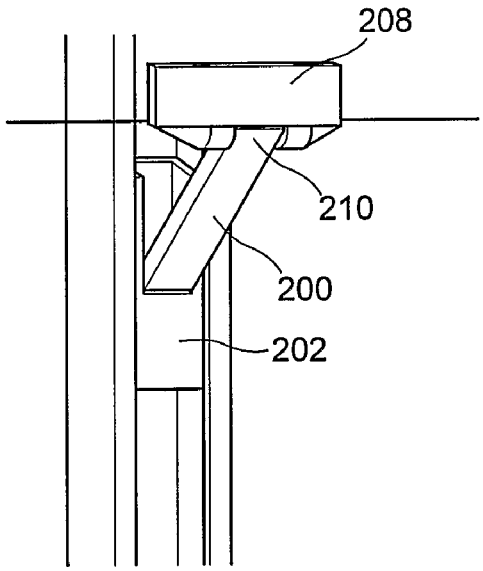
FIGS. 13A and 13B are isometric views showing a third embodiment, in which an arm, pivotally mounted to a runner, supports the carrier plate.
Figure 13B:
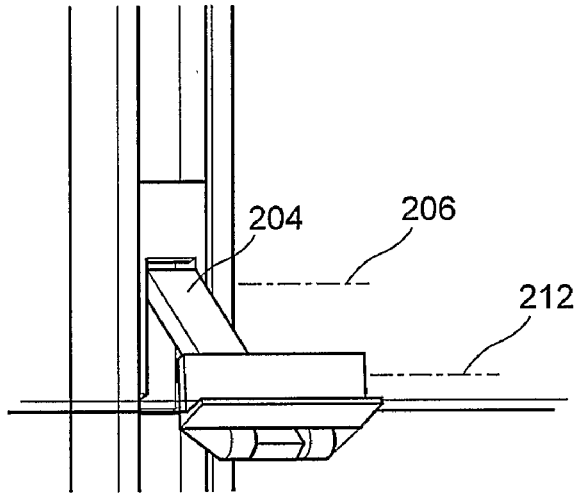

A third embodiment of the invention is illustrated in FIGS. 13A and 13B. Here, arm 200 is pivotally connected to runner 202 at first end 204 having first axis of rotation 206. Carrier plate 208 is connected to the arm 200 at second end 210 having a second axis of rotation 212. Each pivotal connection provides for rotation about an axis that lies in a plane orthogonal to the axis of rotation of the lead screw, and which is also orthogonal to the axis of the drive rod. The two axes of rotation 206, 212 are thus generally parallel to each other. Again, this arrangement permits movement of the carrier plate 208 with respect to the arm 200 and movement of the arm 200 with respect to the runner 202, as the runner 202 moves along the drive rod provides for the movement required of the plate 208 as it moves up and down along the rotating drive rod.

It will be appreciated that a motor of the mechanism can be conveniently mounted through appropriate helical or bevel gears, belt drive, etc. to rotatingly drive the drive rod. Rotation in first angular direction (e.g. clockwise) leads to lifting of the carrier plate and window, and rotation of the drive in a second direction, opposite to the first (e.g., counterclockwise) leads to a lowering of the window. Alternative drive mechanisms to a rotating lead screw or drive can be used. For example, in the second embodiment, the raising and lowering of the runner along the rod guide can be achieved through the use of a cable and drum mechanism, synchronous cable, etc.

The illustrated embodiments have been described with particularity for the purposes of description. Those skilled in the art will appreciate that a variety of modifications may be made to the embodiment described herein without departing from the spirit of the invention.

The invention claimed is:

1. An automotive window regulator system comprising:

a guide rod defining a central axis extending in a vertical direction, said guide rod adapted for rotating about said central axis;

a runner including a body portion and a pair of trunnions, said runner drivingly engaged with said guide rod, said runner moveable in said vertical direction along said guide rod between a first position and a second position in response to rotation of said guide rod; and a window carrier including a primary channel extending in said vertical direction and a secondary channel extending in a lateral direction substantially orthogonal to said vertical direction, said body portion of said runner is disposed in said primary channel which prevents rotation of said runner about said central axis and said trunnions are disposed in said secondary channel thereby coupling said runner and said carrier together for movement of said carrier with said runner in said vertical direction, said trunnions defining a lateral axis substantially orthogonal to said central axis;

wherein said carrier rotates about said lateral axis and said carrier translates in a horizontal direction substantially orthogonal to said vertical and lateral directions such that said trunnions move relative to said carrier in said horizontal direction within said secondary channel in response to moving said runner between said first and second positions, whereby a rotational and translational movement of said carrier permits nonparallel movement of said carrier with respect to said central axis as said runner moves between said first and second positions.

2. A system according to claim 1, including an arcuate window mounted to said carrier, said window having a radius of curvature, said system further including first and second glass run channels, each of said first and second glass run channels having substantially the same radius of curvature as said window, into which first and second edges of said window are received, said glass run channels defining a path of travel of said window as said runner moves between said first and second positions.

3. A system according to claim 1, including an arcuate window mounted to said carrier, said window having a radius of curvature, said system further including a guide engaging said carrier, said guide having substantially the same radius of curvature as said window such that said carrier guides said window along a path coincident with the radius of curvature of said window as said runner moves between said first and second positions.

4. A system according to claim 1, wherein said guide rod is a straight threaded screw and said runner includes a threaded bore threadingly received onto said screw.

5. A system according to claim 4, further including a motor which rotationally drives said screw about said central axis to move said runner between said first and second positions.

6. A system according to claim 1, wherein said trunnions include a respective elliptical surface, each said elliptical surface bearing on opposing surfaces of said secondary channel.

7. A system according to claim 3, wherein said carrier includes a slider channel extending in said vertical direction, said slider channel slidably engaging said guide.

8. An automotive window regulator system comprising:

a guide rod defining a central axis extending in a vertical direction, said guide rod adapted for rotating about said central axis;

a runner including a body portion and a pair of trunnions, said runner drivingly engaged with said guide rod, said runner moveable in said vertical direction along said guide rod between a first position and a second position in response to rotation of said guide rod;

a window carrier including a primary channel extending in said vertical direction and a secondary channel extending in a lateral direction substantially orthogonal to said vertical direction, said body portion of said runner is disposed in said primary channel which prevents rotation of said runner about said central axis and said trunnions are disposed in said secondary channel thereby coupling said runner and said carrier together for movement of said carrier with said runner in said vertical direction, said trunnions defining a lateral axis substantially orthogonal to said central axis;

wherein said carrier rotates relative about said lateral axis and said carrier translates in a horizontal direction substantially orthogonal to said vertical and lateral directions such that said trunnions move relative to said carrier in said horizontal direction within said secondary channel in response to moving said runner between said first and second positions, whereby a rotational and translational movement of said carrier permits nonparallel movement of said carrier with respect to said central axis as said runner moves between said first and second positions;

an arcuate window mounted to said carrier, said window having a radius of curvature; and a guide engaging said carrier, said guide having substantially the same radius of curvature as said window such that said carrier guides said window along a path coincident with the radius of curvature of said window as said runner moves between said first and second positions.

* * * * *